US010625330B2

(12) United States Patent
Traenklein et al.

(10) Patent No.: US 10,625,330 B2
(45) Date of Patent: Apr. 21, 2020

(54) MACHINE TOOLS AND METHODS FOR EJECTING WORKPIECE PARTS

(71) Applicant: TRUMPF Werkzeugmaschinen GmbH + Co. KG, Ditzingen (DE)

(72) Inventors: Dennis Traenklein, Nufringen (DE); Frank Schmauder, Metzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 885 days.

(21) Appl. No.: 15/186,902

(22) Filed: Jun. 20, 2016

(65) Prior Publication Data

US 2016/0368040 A1 Dec. 22, 2016

(30) Foreign Application Priority Data

Jun. 19, 2015 (EP) ..... 15172873

(51) Int. Cl.
*B21D 45/02* (2006.01)
*B21D 28/26* (2006.01)
(Continued)

(52) U.S. Cl.
CPC ..... *B21D 45/02* (2013.01); *B21D 22/02* (2013.01); *B21D 28/265* (2013.01); *B21D 43/282* (2013.01); *B21D 45/003* (2013.01)

(58) Field of Classification Search
CPC .... B21D 22/02; B21D 28/265; B21D 43/282; B21D 45/02; B21D 45/003; B21D 45/04; B21D 45/08
See application file for complete search history.

(56) References Cited

U.S. PATENT DOCUMENTS 5,857,375 A * 1/1999 Nelson ..... B21D 45/003 72/344
6,168,006 B1 1/2001 Bytow
(Continued)

FOREIGN PATENT DOCUMENTS

AT 509 980 1/2012
CN 101489698 7/2009
(Continued)

OTHER PUBLICATIONS

Translation of WO 2012/08332 A1, Danninger et al., pp. 1-15, translated on Sep. 5, 2019. (Year: 2019).*
(Continued)

*Primary Examiner* — Teresa M Ekiert
(74) *Attorney, Agent, or Firm* — Fish & Richardson P.C.

(57) ABSTRACT

The invention relates to machine tools and methods for processing plate-like workpieces. The machine tool comprises a first movement device for the movement of the workpiece in a first direction, two workpiece supporting surfaces spaced apart by a gap extending in a second direction and configured for supporting the workpiece, and a second movement device for the movement of a pressing tool in the second direction. The pressing tool comprises two tool components that are configured to move in a stroke direction relative to one another in order to process the workpiece in the gap by at least one of stamping and shaping. The machine tool also comprises at least one receiving device configured to move in the second direction one or more of in and along the gap for depositing at least one workpiece part formed when processing the workpiece by at least one of stamping and shaping.

16 Claims, 4 Drawing Sheets

(51) Int. Cl.

| | |
|---|---|
| ***B21D 43/28*** | (2006.01) |
| ***B21D 45/00*** | (2006.01) |
| ***B21D 22/02*** | (2006.01) |

(56) References Cited

U.S. PATENT DOCUMENTS

| | | | |
|---|---|---|---|
| 8,122,752 | B2 | 2/2012 | Yamamoto et al. |
| 8,887,366 | B2 | 11/2014 | Buettner et al. |
| 2013/0199014 | A1 | 8/2013 | Buettner et al. |

FOREIGN PATENT DOCUMENTS

| | | | |
|---|---|---|---|
| CN | 102284741 | | 12/2011 |
| EP | 0945196 | A2 | 9/1999 |
| EP | 2177289 | A1 | 4/2010 |
| EP | 2 454 035 | | 5/2012 |
| EP | 2454034 | A1 | 5/2012 |
| EP | 2527058 | A1 | 11/2012 |
| JP | S58188526 | A | 11/1983 |
| JP | 2000-254743 | | 9/2000 |
| JP | 2010-94739 | | 4/2010 |
| JP | 2014-515315 | | 6/2014 |
| WO | WO 2008/010586 | | 12/2009 |
| WO | WO 2012/083332 | | 6/2012 |
| WO | WO 2015/077810 | | 6/2015 |

OTHER PUBLICATIONS

European Search Report in Application No. 17185041.5, dated Dec. 11, 2017, 13 pages (with English translation).

Office Action in Japanese Application No. 2016-120121, dated Jun. 29, 2018, 7 pages (with English translation).

Office Action in Chinese Application No. 201610824397.5, dated May 3, 2018, 22 pages (with English translation).

* cited by examiner

MACHINE TOOLS AND METHODS FOR EJECTING WORKPIECE PARTS

CROSS-REFERENCE TO RELATED APPLICATION

This application claims priority under 35 U.S.C. § 119(a) to European Application No. 15 172 873.0, filed on Jun. 19, 2015, the entire contents of which are incorporated herein by reference.

TECHNICAL FIELD

The present disclosure relates to a machine tool for processing a plate-like workpiece, in particular a metal sheet, by stamping and/or shaping, as well as a method for ejecting workpiece parts from such a machine tool.

BACKGROUND

European Patent Publication EP 2 527 058 A1 discloses a machine tool in the form of a press for processing workpieces, in particular metal sheets. The machine tool disclosed in EP 2 527 058 A1 has a stroke drive device, a pressing tool movable by the stroke drive device along a stroke axis. The stroke drive device in turn may be positioned along a positioning axis extending perpendicular to the stroke axis.

In such a machine tool, differently shaped workpiece parts are typically produced during the processing of the plate-like workpieces. Since external sorting devices require a large surface-area, it is advantageous if differently shaped workpiece parts are sorted in the machine tool during processing of the workpiece.

European Patent Publication EP 0 945 196 A2 discloses a device for sorting workpiece parts on a sheet metal stamping machine for cutting workpieces. The sorting device disclosed in EP 0 945 196 A2 has at least one controllable guide element. Different discharge directions of workpiece parts are assigned to different control states of the guide element. The device is attached to a fixed cutting station of the sheet metal stamping machine.

SUMMARY

The present disclosure relates to machine tools and methods for ejecting workpiece parts that simplify the sorting of workpiece parts during the processing of a workpiece on the machine tools.

In certain embodiments, this is achieved by a machine tool for processing a plate-like workpiece, in particular a metal sheet, by stamping and/or shaping. The machine tool comprises a first movement device configured to move the workpiece in a first direction (X). The machine tool comprises two workpiece supporting surfaces configured to support the workpiece. The two workpiece supporting surfaces are spaced apart by a gap extending in a second direction (Y). The machine tool comprises a second movement device configured to move a pressing tool in the second direction (Y). The pressing tool comprises two tool components that are configured to move in a stroke direction (Z) relative to one another to process the workpiece in the gap by at least one of stamping and shaping. The pressing tool further comprises a receiving device configured to move in the second direction (Y) in the gap for depositing at least one workpiece part formed when processing the workpiece by at least one of stamping and shaping into one or more collection containers.

In some implementations, the gap extending in the second direction, extends perpendicular to the first direction.

In some implementations, the machine tool includes a control system configured for hybrid movement control, in which the workpiece is moved in a first direction (X-direction) and the pressing tool is moved in a second direction (Y-direction). The control may be facilitated by a numerically controlled coordinate guide system including one or more computer controlled actuators or drivers. The pressing tool comprises an upper tool component configured for movement in the stroke direction (Z-direction), for example in the form of a stamping punch, and a lower tool component also configured for movement in the stroke direction, for example in the form of a stamping die. The upper tool component and the lower tool component may be moved in a controlled manner synchronously in the Y-direction inside the gap or optionally also independently of one another. The lower tool component may remain fixed in the stroke direction, while the upper tool component is moved in the stroke direction toward the second tool component or vice versa during the relative movement of the two tool components with respect to one another in the stroke direction for processing the workpiece. During the relative movement both tool components may also be moved in the stroke direction in order to process the workpiece.

In some implementations a receiving device configured for movement along the gap and configured to deposit workpiece parts formed when processing the workpiece is positioned in the gap or the intermediate space between the workpiece supporting surfaces in which the pressing tool is moved. The workpiece parts deposited in the receiving device can have a uniform geometry. The receiving device can be moved in the gap together with the pressing tool or optionally one of the tool components. The receiving device can also be attached to a slide that is able to be displaced independently of the pressing tool and/or of the tool components of the pressing tool in the second direction in the gap. In the simplest case, the workpiece part(s) stored in the receiving device may be removed automatically or manually from the receiving device, for example when the receiving device is moved to one of the two outer edges of the gap. A controlled mobility of the receiving device in the gap permits the workpiece parts received in the receiving device to be positioned at different ejection positions along the gap where, for example, the workpiece parts can be ejected into different collection containers, or the like, at the ejection positions.

Within the meaning of this application a "workpiece supporting surface" is understood as a workpiece support that is suitable for supporting the plate-shaped workpiece in a planar manner. Such a workpiece supporting surface does not have to form a continuous surface but it is sufficient if the workpiece is supported at a plurality of points (at least three, generally considerably more points) by support elements (optionally only in a punctiform manner), in order to store the workpiece in a supporting plane, i.e. the workpiece supporting surface in this case is formed by the upper faces of the supporting elements. The workpiece supporting surfaces may, for example, be configured in the form of a brush table or ball table, the gap being formed between the workpiece supporting surfaces. The workpiece to be processed in this case is supported during the processing by a plurality of supporting elements arranged on and/or in a table surface in the form of brushes or (rotatable) balls which together form the workpiece supporting surface. Alternatively, rotatable rollers arranged parallel to the gap, the rotational axis thereof extending parallel to the gap, may be provided as supporting elements for forming workpiece supporting surfaces. Moreover, it is possible to design the workpiece supporting surfaces as revolving supporting belts.

In some embodiments, the receiving device is attached to one of the tool components of the pressing tool and is configured to move in the gap together with the tool component. The receiving device in this case is typically attached to the lower tool component in the stroke direction, for example a stamping die, and the receiving device is typically arranged at least partially, generally entirely, below the workpiece plane that is defined by the upper faces of the two workpiece supporting surfaces. The receiving device in this case is typically arranged in the gap in the second direction (Y-direction) laterally adjacent to the second tool component or below the second tool component, i.e. the gap is not widened by the receiving device in the first direction (X-direction). The receiving device in this case is typically only arranged so far from the tool component that workpiece parts completely detached from the workpiece are able to enter the receiving device by the action of gravitational force. Guide devices, for example in the form of chutes or the like, may serve for the transportation of workpiece parts from the tool component to the receiving device.

The second tool component, for example in the form of a stamping die, may have a continuous opening, typically the first tool component in the form of a stamping punch partially penetrating therein during the movement in the stroke direction, in order to detach a workpiece part from the (remaining) workpiece. Through the opening in the stamping die, small workpiece parts in the form of stamped-out slugs (scrap metal) and optionally good parts may drop down through a so-called splinter pipe that adjoins the opening and is formed in a stamping support. The receiving device may be arranged below the stamping die, for example on the stamping support, in order to receive workpiece parts (scrap or optionally good parts) dropping down through the opening in the stamping die by the action of gravitational force.

In a further embodiment, the receiving device comprises a parts container for depositing at least one workpiece part, preferably a plurality of workpiece parts. In the simplest case the parts container is open at the top and serves for depositing a plurality of workpiece parts that are formed when processing the workpiece. The workpiece parts are collected in the parts container and may optionally be removed therefrom manually or automatically. The cross section of the parts container preferably increases continuously in the Z-direction from the plane of the workpiece supporting surfaces as far as the bottom region of the parts container in order to prevent jamming of workpiece parts. To this end, the parts container may have a basic shape that widens conically toward the container base.

In a further embodiment, the receiving device comprises a controllable ejection device for ejecting workpiece parts deposited in the receiving device. The ejection device typically has at least two control states, wherein in a first control state the workpiece parts remain in the ejection device and in a second control state the workpiece parts are ejected from the receiving device, for example via an opening. The receiving device may in addition to the second control state have a third, fourth, . . . control state, in which in each case workpiece parts are ejected in different ejection directions from the receiving device. Generally, all workpiece parts deposited in the receiving device are ejected together from the ejection device.

In a further embodiment, the machine tool comprises a control device for the movement of the receiving device to different ejection positions along the gap, and for controlling the ejection device for ejecting workpiece parts at the different ejection positions along the gap. The control device serves for the numerical control of the machine tool, for example the first and the second movement device and a stroke drive. If the receiving device is attached to a tool component of the pressing tool, the control device acts on the second movement device in order to move the receiving device to a respective ejection position along the gap. If the receiving device is able to be displaced in the gap by means of a separate movement device and/or a separate drive, the control device acts on this movement device and/or on the drive in order to position the receiving device at a predetermined ejection position along the gap. If the receiving device is able to be moved independently of the tool component along the gap, the receiving device may be moved between one respective ejection position for ejecting workpiece parts and a position adjacent to the tool component at which the receiving device receives workpiece parts that are formed on the tool component.

The ejection positions are typically predetermined positions in the second direction (Y-direction) along the gap. At one respective ejection position, for example, a collection container or the like may be arranged in order to collect workpiece parts ejected from the receiving device via the ejection device. The collection containers may, for example, be arranged in a row in the second direction at the side adjacent to the gap in order to collect and/or to sort workpiece parts. In particular, two rows of collection containers that are arranged below one respective workpiece supporting surface to the side adjacent to the gap may be provided. Additionally or alternatively, a row of collection containers may be arranged in the gap, for example, in order to eject workpiece parts that drop down through the opening in the second tool component and that are received by the receiving device arranged below the second tool component. The collection container in one, two or optionally in a plurality of rows may, for example, be arranged on a hand cart that is positioned adjacent to and/or below the gap and/or the machine frame and optionally is aligned by means of positioning aids relative to the machine and/or to the gap.

In some implementations, the controllable ejection device comprises at least one pivotable flap that has a first pivoted position for supporting workpiece parts deposited in the receiving device and a second pivoted position for ejecting workpiece parts from the receiving device. A first switching position of the ejection device in this case corresponds to the first pivoted position of the pivotable flap and a second switching position of the ejection device corresponds to the second pivoted position of the pivotable flap. In the first pivoted position of the flap, the flap forms on its upper face a supporting surface for workpiece parts. To this end, the flap extends in the first pivoted position typically (approximately) horizontally and/or (approximately) parallel to a workpiece supporting plane formed by the workpiece supporting surfaces. In the second pivoted position the flap is aligned at a larger angle to the horizontal and/or to the workpiece supporting plane (downwardly) so that the workpiece part(s) in the second pivoted position slides or slide along the upper face of the flap and in this manner are ejected from the receiving device.

In some implementations, a pivot axis of the pivotable flap is aligned parallel to or perpendicular to the second direction. In the first case, by the pivoting of the flap from the first into the second pivoted position the workpiece part(s) is or are ejected to the side, i.e. transversely to the gap in the direction of one of the two workpiece supporting surfaces, the gap being formed therebetween. As has been described above, a plurality of collection containers may be arranged on one or optionally on both sides of the gap, the workpiece parts being ejected therein. In the second case, the workpiece parts may be ejected by pivoting the flap from the first pivoted position into the second pivoted position into the gap between the workpiece supporting surfaces and, for example, collected and sorted in collection containers arranged there.

In further embodiments, the flap has a third pivoted position for ejecting workpiece parts from the receiving device, wherein an ejection direction in the second pivoted position differs from an ejection direction in the third pivoted position. By pivoting the flap into the second pivoted position or third pivoted position, the workpiece parts may be ejected in different ejection directions and, for example, received in different collection containers. The flap may, for example, be rotated to the right from the first typically substantially horizontal position into the second pivoted position and to the left into the third pivoted position, or vice versa. If the pivot axis in this case extends parallel to the second direction (Y-direction) the workpiece parts are ejected in the first ejection direction sideways to a first side of the gap and in the second ejection direction sideways to a second side of the gap. In this manner, the workpiece parts, for example, may be ejected in receiver containers that are positioned on both sides of the gap, sideways to the gap. This is advantageous since in this manner the number of receiver containers in which the workpiece parts may be received at the side of the gap is increased.

In further embodiments, the pivotable flap forms a bottom region of the parts container. In such embodiments, the receiving device comprises a parts container for collecting workpiece parts, the bottom region thereof forming a flap that is moved into the second (or optionally the third) pivoted position in order to eject workpiece parts from the parts container. In principle, the workpiece parts may also be removed from the parts container in a different manner than through a pivotable flap. For example, the bottom region of the parts container may comprise one or more regions that are not pivoted for ejecting workpiece parts but are moved to the side in order to produce an opening in the bottom region of the parts container.

In certain embodiments, the machine tool comprises a further pivotable flap that is formed on a side region of the parts container, wherein the further pivotable flap in a first pivoted position is adjacent to the bottom region of the parts container formed by the pivotable flap, and wherein the further pivotable flap in a second pivoted position is spaced apart from the bottom region of the parts container, so that between the bottom region and the flap that has been opened further an opening is formed in the side region of the parts container. The further flap is typically articulated at its upper edge on the side and/or on a side region of the parts container and is moved from the first lower pivoted position in which the flap closes the side region of the parts container, into the second upper pivoted position in which the further flap pivots outwardly and opens up an opening in the side region of the parts container. The flap and the further flap are preferably pivoted synchronously, i.e. the flaps reach the first and the second pivoted position substantially at the same time. Typically, the pivot axes of the flap and the further flap are aligned in parallel and spaced apart from one another. The opening which is produced when pivoting the flap forming the bottom region into the second pivoted position may be enlarged by means of the further flap. In this manner, in the event that in the second pivoted position the flap only has a relatively small angle of, for example, less than ca. 30° from the horizontal, relatively large workpiece parts deposited in the parts container may be ejected.

Preferably, the pivotable flap and the further pivotable flap are coupled together in terms of movement, for example via a coupling gear. By "coupling in terms of movement" is understood that both flaps are able to be pivoted via a single actuator synchronously from the first into the second pivoted position and vice-versa. For the coupling in terms of movement it has proved advantageous if the pivot axes of the two flaps are aligned parallel to one another.

The receiving device does not necessarily have to have a parts container in order to receive and/or collect a plurality of workpiece parts. Instead, the pivotable flap in the first pivoted position may form a supporting surface on which optionally a plurality of workpiece parts may be collected before the workpiece parts are ejected by the flap being pivoted into the second or optionally a third, fourth, pivoted position. The workpiece parts positioned on the flap forming a supporting surface as described above may move together with the lower tool component in the second direction along the gap and may be moved to a suitable ejection position along the gap. The flap may optionally be pivotably mounted around more than one pivot axis, as is described in EP 0 945 196 A2 cited above, which is incorporated by reference in its entirety to the contents of this application.

It is not necessarily required for the receiving device to have a deposit surface that is formed on a pivotable flap. For example, the deposit surface as described in EP 0 945 196 A2 may be formed on the upper face of an endless conveyor belt, which is used as an ejection device of the receiving device and which in a first switching position in which the conveyor belt is not moved serves for depositing workpiece parts and in a second or optionally third switching position serves as an ejection device in order to eject workpiece parts deposited on the conveyor belt sideways. The endless conveyor belt is, in particular, able to be controlled in its direction of movement in order to eject workpiece parts in a second and/or third switching position on both sides of the gap.

In further developments, the ejection device comprises at least one ejection chute for ejecting workpiece parts from the receiving device in an ejection direction extending transversely to the second direction. The workpiece parts may be moved along the ejection chute in a direction transversely to the gap and, for example, may be received in collection containers or the like. An upper end of the ejection chute typically adjoins the flap pivoted into the second, third, pivoted position. The receiving device may have, in particular, two ejection chutes that are attached on opposing sides of the parts container or on opposing sides of a pivotable flap and/or rocker in order to eject workpiece parts on different sides of the gap.

In further embodiments, the receiving device comprises a feeding chute for feeding workpiece parts from one of the tool components of the pressing tool. The tool component of the pressing tool may, for example, be a stamping die. The feeding chute can be configured for feeding workpiece parts from the tool component to the receiving device substantially in the second direction (Y-direction). At the lower end of the feeding chute, for example, an upper opening of the parts container or a deposit surface may be arranged, the workpiece part being deposited thereon before it is ejected. After being processed by stamping and/or shaping, the workpiece parts may tip onto the feeding chute by the action of gravitational force, provided the center of gravity thereof is above the feeding chute. However, it is also possible to move the workpiece parts onto the feeding chute by the tool component to which the receiving device is attached, by performing a movement relative to the workpiece part that is so rapid that the tool component is pulled away under the workpiece part, so that the workpiece part is conveyed from the tool component onto the adjacently arranged feeding chute.

In further embodiments, the machine tool comprises a sensor device for detecting workpiece parts that pass the feeding chute or that protrude upwardly out of the parts container. The sensor device may, for example, be configured as a light barrier or light grid in which a plurality of light barriers are arranged adjacent to one another in order to permit a two-dimensional detection of workpiece parts. The sensor device may be arranged at the lower end of the feeding chute. If the receiving device is configured as a parts container, the sensor device may monitor the upper opening of the parts container at which the feeding chute ends.

The machine tool may alternatively or additionally have a (further) sensor device for detecting workpiece parts that pass the feeding chute or a respective ejection chute. To this end, the sensor device may be attached to the lower end of the ejection chute. The sensor device may, for example, be configured as a light barrier or light grid.

In further embodiments, the receiving device is arranged below a continuous opening in the second lower tool component of the pressing tool. In such embodiments, the second tool component can be a stamping die and the opening a die opening. In such a stamping die in conventional stamping presses a generally continuous opening is formed for the engagement, for example, of a stamping punch or another processing tool, typically a (splinter) pipe or the like being located therebelow and the workpiece parts in the form of scrap and/or stamped-out slugs dropping down through the pipe. Since workpieces from different materials are typically processed on a machine tool and the stamped-out slugs are generally collected only if numerous workpieces have been processed, on a conventional machine tool the stamped-out slugs are not separated according to type.

By means of the receiving device in the machine tool according to the invention the stamped-out slugs are sorted into different receiving containers along the gap and thus separated according to type, which is advantageous for the disposal of stamped-out slugs. By the provision of a plurality of receiving containers that, for example, are arranged in a row below the gap, the receiving capacity of the machine tool for stamped-out slugs may be increased. Also, intermediate emptying of the receiving container may be carried out in a manner that is optimal in terms of time. For example, the standard emptying position and/or the standard ejection position for scrap parts (stamped-out slugs) or good parts may be selected in the region of a tool-change position along the gap, in order to eject the workpiece parts when the tool components of the pressing tool are changed. In the event that intermediate emptying is required, for example because the receiving device (splinter pipe) is full, when the sorting of the workpiece parts is dispensed with, an emptying of the receiving device that is optimal in terms of time may take place at the next receiving container.

When using a suitable pressing tool, good parts may also be stamped out, the good parts also dropping through the die opening in the stamping die and being received by the receiving device. For receiving the good parts, a specific collection container may be provided in the machine tool. When using a suitable pressing tool in the machine tool, a first good part may be received by means of the receiving device described above and arranged to the side of the pressing tool and simultaneously a second good part may be received by the (further) receiving device that is arranged below the second tool component. The two good parts may be moved into a desired collection container adjacent to the gap and/or in the gap, by the respective receiving device, typically together with the second tool component, being positioned along the gap at a suitable ejection position. As has been described above, one or optionally both receiving devices may be moved independently of the pressing tool and/or the tool component thereof inside the gap, in order to eject good parts and/or scrap at a desired ejection position.

In certain implementations, the machine tool additionally comprises at least one guide element, in particular a guide plate, for guiding workpiece parts when ejected from the receiving device in collection containers arranged inside the gap. Typically, the workpiece parts (scrap or good parts) drop down out of the receiving device under the action of gravitational force when the ejection device is opened. In order to ensure that the workpiece parts in this case fall into the receiving containers, at least one guide element may be arranged at the height of the ejection device, for example at the height of a pivotable flap of the ejection device, below which the collection containers are arranged. The guide element(s) typically extends or extend to the side along the gap so that workpiece parts are not able to enter the region below the workpiece supporting surfaces to the side out of the gap but drop in the direction of the collection containers.

A further feature of the invention relates to methods for ejecting workpiece parts from a machine tool as described above. The method comprises moving, by a first movement device, a workpiece into position for processing by at least one of stamping and shaping the workpiece. Moving comprises movement in a first direction (X). The method comprises supporting the workpiece with two workpiece supporting surfaces spaced apart by a gap extending in a second direction (Y) and configured for supporting the workpiece. The method comprises supporting the workpiece with a second movement device for movement of a pressing tool in the second direction. The pressing tool comprises two tool components that are configured to move in a stroke direction (Z) relative to one another. The method comprises processing the workpiece by moving one or more of the two tool components in the stroke direction (Z) relative to one another to cut off at least one workpiece part from the workpiece by the at least one of stamping and shaping of the workpiece. The method comprises depositing, after processing, the cut off workpiece part in a receiving device configured to move in the second direction (Y) in the gap. The method comprises moving the receiving device in the second direction (Y) along the gap until one of a plurality of ejection positions (YA1, . . . YA3) along the gap is reached. The method comprises ejecting the cut off workpiece part from the receiving device at the ejection position (YA1, . . . YA3).

As has been described above, by moving the receiving device in the gap, workpiece parts may be sorted by being ejected out of the receiving device at different ejection positions along the gap. If the ejection device together with a tool component of the pressing tool is moved in the gap, the processing of the workpiece is possibly interrupted for the ejection, until the workpiece part(s) is or are ejected. However, it is also possible to eject one or more workpiece parts from the ejection device at the ejection position at the same time as processing the workpiece.

In certain variants of the method, a relative movement takes place between one of the tool components of the pressing tool and a workpiece part supported on the tool component for conveying the workpiece part from the tool component into the receiving device. In this case, a movement of the tool component takes place in the second direction that is sufficiently rapid that the tool component is pulled away from below the workpiece part, so that the workpiece part is conveyed from the tool component—optionally via a feeding chute—into the receiving device arranged adjacent thereto, even when the center of gravity of the workpiece part is not located above the feeding chute.

In some implementations the method includes sensing a workpiece part deposited into the receiving device. The ejection position of the receiving device can be controlled based on the workpiece part sensed in the receiving device.

Further advantages of the invention are derived from the description and the drawings. Also the features cited above and set forth below may be used individually or combined together in any manner to form multiple combinations. The embodiments shown and described are not to be understood as a conclusive list but instead are of an exemplary nature for describing the invention.

DETAILED DESCRIPTION

Figure 1:
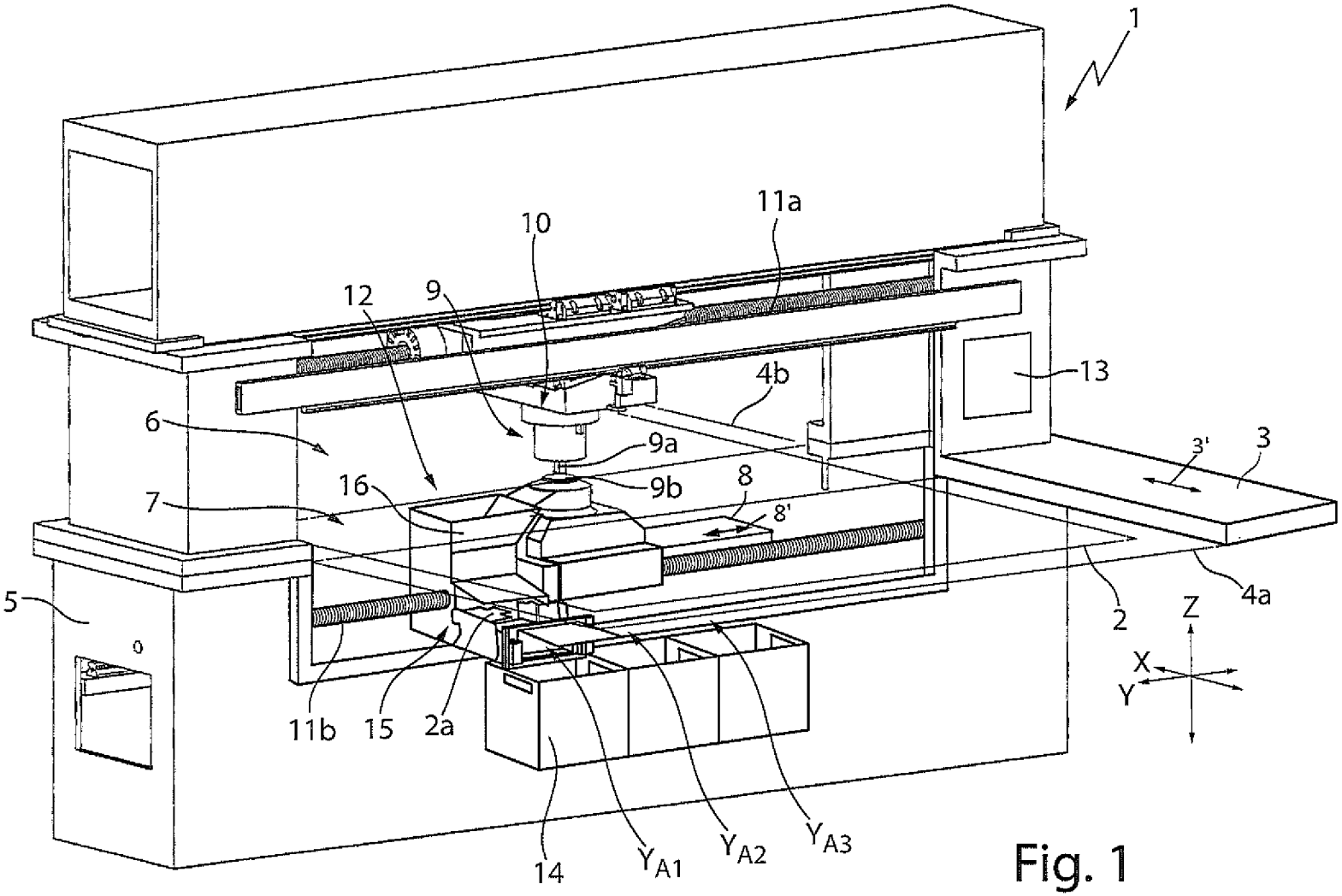
FIG. 1 shows a schematic view of an example of an embodiment of a machine tool in the form of a stamping press with a receiving device that is able to be moved within a gap for depositing workpiece parts.

Identical reference numerals are used in the following description of the drawings for components that are the same and/or functionally the same.

FIG. 1 shows an example of a machine tool 1 in the form of a stamping press that in the example shown is configured for processing a plate-like workpiece 2 in the form of a metal sheet, by stamping and optionally by shaping. The machine tool 1 comprises a first movement device 3 configured to move the workpiece 2 in the direction 3' to displace the workpiece 2 supported on two workpiece supporting surfaces 4*a*, 4*b* shown in dashed lines in a first direction (X-direction hereinafter) of an XYZ coordinate system shown in FIG. 1. The workpiece supporting surfaces 4*a*, 4*b* may, for example, be formed on the upper face of workpiece tables that are provided with rollers (not shown) for the support of the workpiece 2. The first movement device 3 may comprise a numerically controlled coordinate guide that laterally clamps the workpiece 2 and moves the workpiece in the X-direction over the workpiece supporting surfaces 4*a*, 4*b*.

The machine tool 1 comprises, in the example shown, an O-shaped machine frame 5 that is arranged between the workpiece supporting surfaces 4*a*, 4*b* and that encloses a frame interior 6 that forms the processing region of the stamping press. A gap 7 is formed in the frame interior 6 between the workpiece supporting surfaces 4*a*, 4*b*. The gap extends in a second direction (Y-direction hereinafter) perpendicular to the X-direction. A second movement device 8 serves for moving a pressing tool 9 in the Y-direction along the gap 7, as indicated by double-headed arrow 8'. The pressing tool 9 comprises a first upper tool component in the form of a stamping punch 9*a* and a second lower tool component in the form of a stamping die 9*b*. The stamping die 9*b* has a die opening into which the stamping punch 9*a* penetrates during the stamping processing of the workpiece 2. For the movement of the stamping punch 9*a* in a stroke direction (Z-axis hereinafter) the machine tool 1 has a stroke drive 10 that acts on a plunger, wherein the stamping punch 9*a* is attached to the lower end thereof.

The second movement device 8 comprises an upper and lower drive spindle 11*a*, 11*b*, which are rotatably connected to the machine frame 5 and the stroke drive 10 with the stamping punch 9*a* and/or the stamping die 9*b* are attached to the spindle nuts thereof to move the stamping punch and/or stamping die in the Y-direction. To this end, the second movement device 8 comprises a motorized drive, not shown in more detail, by which the stamping punch 9*a* and the stamping die 9*b* can be moved synchronously in the gap 7 and/or in the frame interior 6. The second movement device 8 can optionally be configured to displace the stamping die 9*b* independently of the stamping punch 9*a* in the Y-direction. The second movement device 8 may have two separately controllable drives, but it is also possible that the movement device 8 has only one motorized drive and the synchronous movement of the stamping punch 9*a* and the stamping die 9*b* takes place via a mechanical coupling gear.

In the example shown, the machine tool 1 comprises a receiving device 12 for depositing workpiece parts 2*a* (see FIG. 2*c*) that are separated from the workpiece 2 during the processing by stamping. The receiving device 12 can be moved in the Y-direction in the gap 7 and in the example shown is attached and/or mounted on the stamping die 9*b*, more specifically on a stamping support connected thereto and that forms a part of the spindle nut of the lower drive spindle 11*b*. The receiving device 12 also forms a part of the spindle nut of the lower drive spindle 11*b* and can be moved in the gap 7 together with the stamping die 9*b* by means of the second movement device 8.

The machine tool 1 comprises a control device 13 that, amongst other things, numerically controls the first and second movement devices 3, 8 as well as the stroke drive 10. The control device 13, in the example shown, is configured and/or programmed to move the receiving device 12 together with the stamping die 9*b* in a controlled manner to different ejection positions $Y_{A1}, \ldots Y_{A3}$ along the gap 7, in order to eject workpiece parts 2*a* deposited in the receiving device 12 laterally out of the gap 7. The control device 13 selects the ejection position $Y_{A1}, \ldots Y_{A3}$ depending on the type, in particular on the geometry, of the workpiece parts 2*a* deposited in the receiving device 12. In the example shown in FIG. 1, in each case a box-shaped collection container 14 is arranged at a respective ejection position $Y_{A1}, \ldots Y_{A3}$ to receive the workpiece parts 2*a* deposited in the receiving device 12 and ejected at the ejection position $Y_{A1}, \ldots Y_{A3}$. By means of the receiving device 12, in this manner workpiece parts 2*a* may be ejected and thus sorted depending on their type and/or geometry into different collection containers 14. For simplification purposes, only three collection containers 14 are shown in FIG. 1, but generally collection containers 14 are arranged along the entire extent of the gap 7 in the Y-direction.

For ejecting workpiece parts 2*a* at a respective ejection position $Y_{A1}$, . . . YA3 the receiving device 12 comprises an ejection device 15 that is subsequently described in more detail with reference to FIG. 2A and FIG. 2B. The receiving device 12 in the example shown in FIGS. 2*a, b* comprises a box-shaped parts container 16, into which workpiece parts 2*a* can be deposited and collected. The parts container 16 has a cross section that widens toward the bottom region to prevent jamming of the workpiece parts 2*a*. In the example shown, the ejection device 15 comprises a pivotable flap 17 that forms a bottom region of the parts container 16. The flap 17 is pivotable from a first substantially horizontal pivoted position S1 shown in FIG. 2A for supporting workpiece parts 2*a* into a second pivoted position S2 shown in FIG. 2B. In the first pivoted position S1 the flap 17 closes the parts container 16, and in the second pivoted position S2 the flap 17 is inclined downwardly by ca. 30° relative to the first pivoted position S1, whereby the workpiece parts 2*a* supported on the flap 17 slide along the upper face of the flap 17 in order to empty the parts container 16 and to eject the workpiece parts 2*a* sideways out of the gap 7. A pivot axis 18 of the pivotable flap 17 extends in the Y-direction so that the workpiece parts 2*a* are ejected via the flap in an ejection direction A1 that extends in a plane transversely to the Y-direction and thus transversely to the gap 7.

Figure 2A:
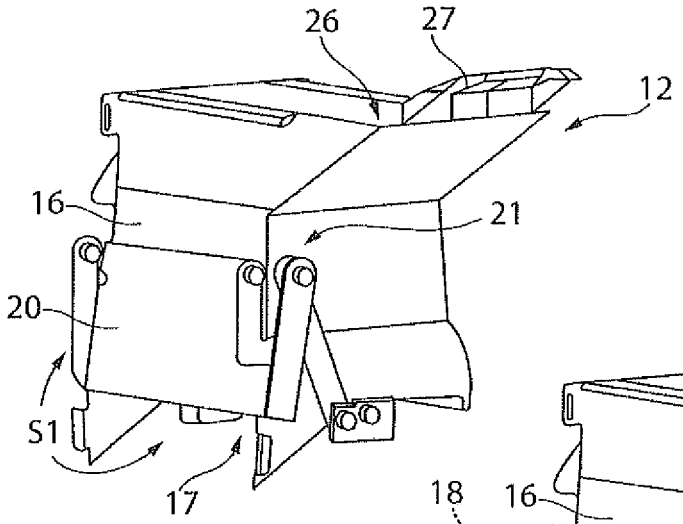
FIGS. 2A-2D show four schematic views of a receiving device with a parts container for receiving workpiece parts.
Figure 2B:
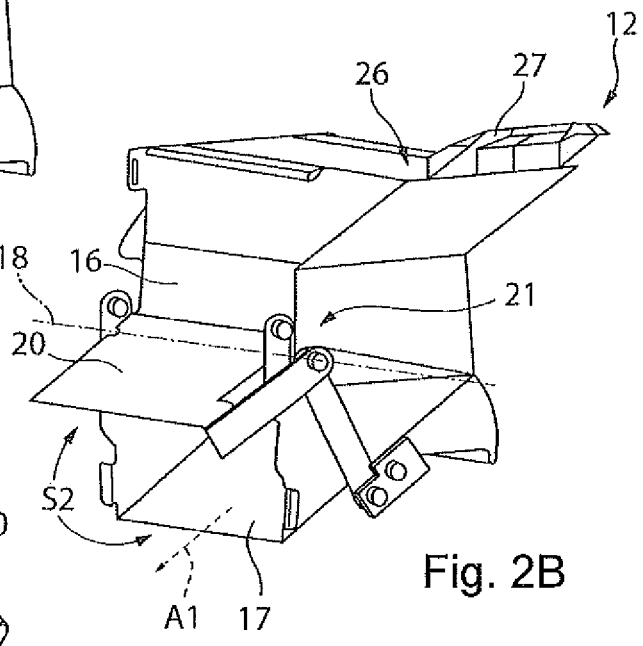

In the example shown in FIGS. 2A and 2B, the ejection device 15 comprises an actuator in the form of a cylinder 19 that is able to be pneumatically actuated by means of the control device 13 (see FIG. 2D) and that is attached to the outer face of the parts container 16, in order to pivot the pivotable flap 17 from the first pivoted position S1 into the second pivoted position S2 and vice-versa. As has been described above, the angle between the first pivoted position S1 and the second pivoted position S2 of the flap 17 in the example shown is only ca. 30° so that the opening formed between the lower end of the flap 17 located in the second pivoted position S2 and the parts container 16 is at a relatively low height.

The ejection device 15 in the example shown has a further pivotable flap 20 that is attached to a side region of the parts container 16 and that is attached approximately at the height of the lower third of the side region in an articulated manner to the parts container 16 so as to enlarge the opening and in this manner to simplify the emptying of the parts container 16. In a first pivoted position S1 shown in FIG. 2A, the further flap 20 adjoins the flap 17 located in the first pivoted position S1 and forms in the first pivoted position S1 a part of the side wall of the parts container 16. Workpiece parts 2*a* bearing against the flap 17 in the first pivoted position S1 are thus prevented by the further flap 20 from falling out to the side from the parts container 16. In the example shown, the further flap 20 on the side region of the parts container 16 is coupled in terms of movement to the flap 17 on the bottom region of the parts container 16 via a mechanical coupling gear 21. By means of the coupling in terms of movement, when the actuator 19 and/or the cylinder are actuated, the further flap 20 is synchronously pivoted with the flap 17, so that the flap 17 and the further flap 20 are pivoted together from the first pivoted position S1 into the second pivoted position S2 and vice-versa. In the second pivoted position S2, shown in FIG. 2*b*, the further flap 20 is pivoted upwardly by an angle of ca. 30° and protrudes to the side over the side region of the parts container 16. In the second pivoted position S2, the further flap 20 is thus spaced apart from the flap 17 forming the bottom region and increases the height of the opening via which the parts container 16 may be emptied. By means of the enlarged opening, relatively large workpiece parts 2*a* may also be ejected from the parts container 16.

Figure 2C:
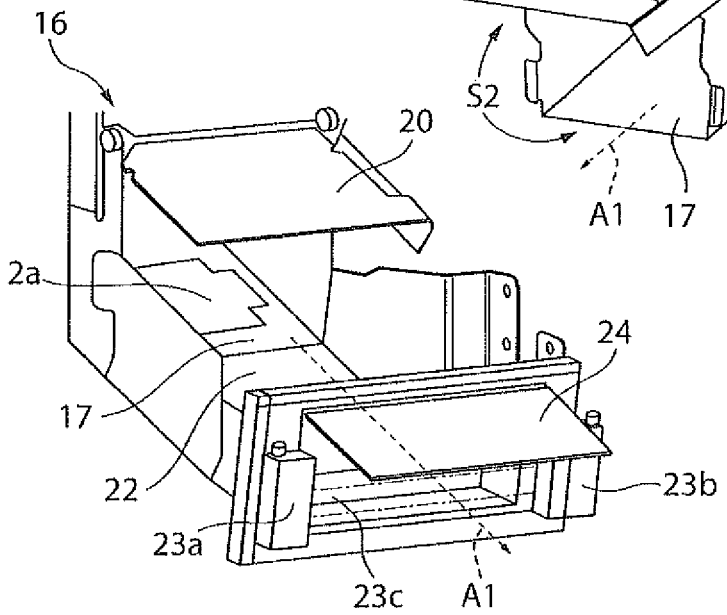

FIG. 2C shows a detail of the receiving device 12 with the lower end of the parts container 16 in which the pivotable flap 17 and the further pivotable flap 20 are arranged in the second switching position S2. As can be identified in FIG. 2C, the ejection device 15 has an ejection chute 22 that adjoins the flap 17 located in the second pivoted position S2, to eject workpiece parts 2*a* in the ejection direction A1 transversely to the Y-direction and thus transversely to the gap 7. As may also be identified in FIG. 2C, a light barrier 23*c* is formed at the lower end of the ejection chute 22 between a transmitter 23*a* and a receiver 23*b*, to detect workpiece parts 2*a* that have passed the ejection chute 22 and thus have been moved into a collection container 14 shown in FIG. 1. A deflection plate 24 is attached to a frame above the lower end of the ejection chute 22 to guide the workpiece parts 2*a* in the ejection direction A1 to one respective collection container 14. The deflection plate 24 prevents workpiece parts 2*a* from jumping over the light barrier 23*c* and optionally the collection container 14, due to vibrations caused by the process.

Figure 2D:
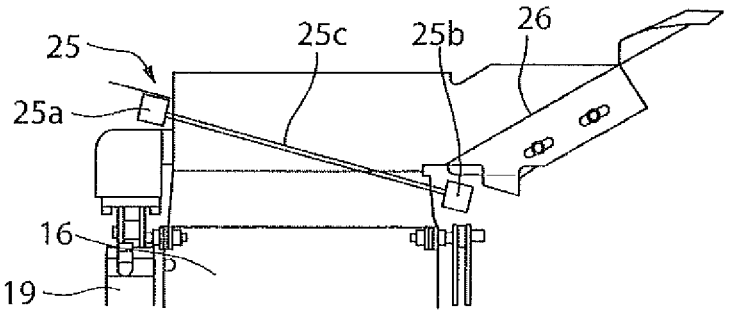

FIG. 2D shows a sectional view of the upper edge of the parts container 16, a sensor device 25 with a transmitter 25*a* and receiver 25*b* formed on opposing sides of an upper opening of the parts container 16 being provided thereon, a two dimensional light grid 25*c* being produced therebetween to monitor whether workpiece parts 2*a* protrude upwardly from the parts container 16, i.e. to monitor whether the parts container 16 is completely full.

The sensor device 25 also makes it possible to monitor whether a workpiece part 2*a* has passed or not passed a feeding chute 26 for feeding workpiece parts 2*a* from the stamping die 9*b* to the parts container 16 and/or to the receiving device 12. To this end, the light grid 25*c* of the sensor device 25 is formed at the lower end of the feeding chute 26. As may also be identified in FIGS. 2A-2D, the feeding chute 26 at its upper end has a collar 27 that at the side partially surrounds the circular outer contour of the stamping die 9*b*. If the workpiece parts 2*a* are to be conveyed into the parts container 16, the center of gravity thereof not being located above the feeding chute 26 after the workpiece 2 has been cut out, a relative movement can be produced between the stamping die 9*b* and the workpiece part 2*a* supported thereon, by the stamping die 9*b* being moved sufficiently rapidly in the Y-direction in the gap 7 that the stamping die 9*b* is pulled away under the workpiece part 2*a* and the feeding chute 26 is positioned below the workpiece part 2*a*.

The parts container 16 may be provided on its upper face with a workpiece supporting surface (not shown) that is moved with the receiving device 12 in the gap 7. A lateral opening remains between the feeding chute 26 and the workpiece supporting surface, which is sufficiently large, to accommodate the workpiece parts 2*a* in the parts container 16. Also, parts of a workpiece supporting surface may optionally be attached to the stamping die 9*b*, the workpiece supporting surface being moved with the stamping die 9*b* in the gap 7.

Figure 3A:
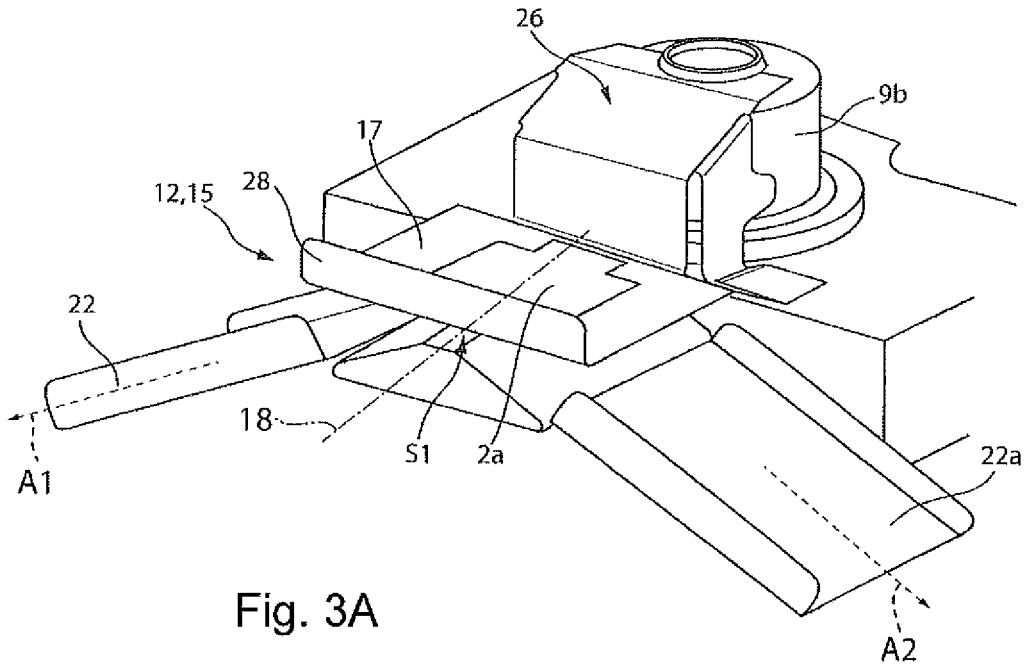
FIGS. 3A-3B show two views of a receiving device with a pivotable flap in a first pivoted position and a second pivoted position.
Figure 3B:
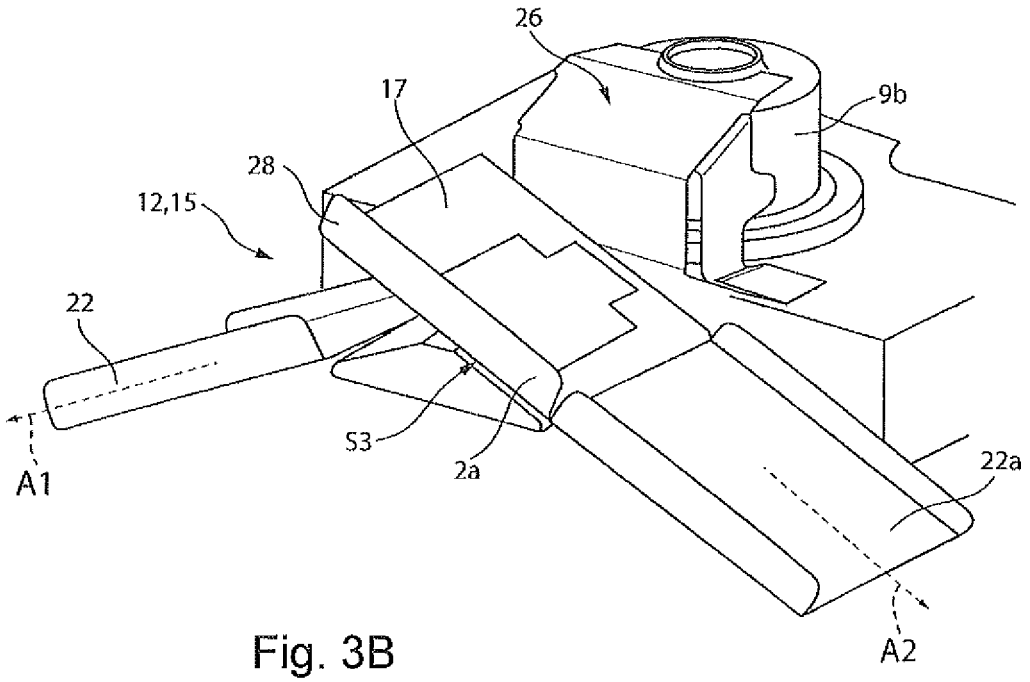

FIGS. 3A and 3B show a further example of a receiving device 12, which differs from the receiving device 12 described in connection with FIGS. 2A-2D in that a parts container 16 is not provided for collecting workpiece parts 2*a*: in the case of the receiving device 12 shown in FIGS. 3A and 3B, instead a workpiece part 2*a* is directly deposited on a flap 17 that at the same time is part of an ejection device 15 and that is located in FIG. 3A in a first horizontal pivoted position S1. Optionally, a plurality of workpiece parts 2*a* can be deposited and/or collected on the flap 17 serving as a supporting surface before they are ejected from the ejection device 12. To this end, the pivotable flap 17 may be pivoted into a second pivoted position S2, not illustrated in FIGS. 3A and 3B, in which the workpiece part 2*a* supported on the flap 17 is ejected in a first ejection direction A1 via a fixed ejection chute 22 into a collection container, not shown in FIGS. 3A and 3B, and which, for example, may be arranged at the side adjacent to the gap 7 below the second workpiece supporting surface 4*b* of the machine tool 1.

FIG. 3B shows the flap 17 in a third pivoted position S3 that is inclined downwardly by ca. 30° relative to the first pivoted position S1 shown in FIG. 3A. In the third pivoted position S3, the workpiece part 2*a* is conveyed onto a further ejection chute 22*a*, the workpiece part 2*a* being able to slide along the chute and being able to be collected in a collection container, not illustrated, which for example may be arranged below the first workpiece supporting surface 4*a* of the machine tool 1. The receiving device 12 shown in FIGS. 3A and 3B, thus permits an ejection of workpiece parts 2*a* on both sides of the gap 7. Also, the receiving device 12 shown in FIGS. 2A-2D, more specifically the ejection device 15 thereof, may optionally be configured such that workpiece parts 2*a* may be ejected on both sides of the gap 7.

The receiving device 12 shown in FIGS. 3A and 3B, similar to the receiving device 12 shown in FIGS. 2A-2D, has a feeding chute 26 to convey workpiece parts 2*a* from the stamping die 9*b* to the pivotable flap 17. The flap 17 that is able to pivot about a pivot axis 18 parallel to the Y-direction has a stop 28 at its side located opposite the feeding chute 26. The flap 17 is pivoted by means of an actuator into the three different pivoted positions S1 to S3, wherein the actuator, for example, may be configured as described in EP 0 945 196 A2. The flap 17 may optionally also be pivoted about more than one pivot axis, as is also described in EP 0 945 196 A2.

Instead of the pivotable flap 17 the receiving device 12 shown in FIGS. 3A and 3B can, for example, have an endless conveyor belt that is able to be optionally controlled in its direction of movement, workpiece parts 2*a* being able to be deposited thereon and the workpiece parts 2*a* being able to be optionally transported thereby to one of the two ejection chutes 22, 22*a* or optionally directly into the collection containers 14 that are arranged to the side adjacent to the gap 7.

Figure 4A:
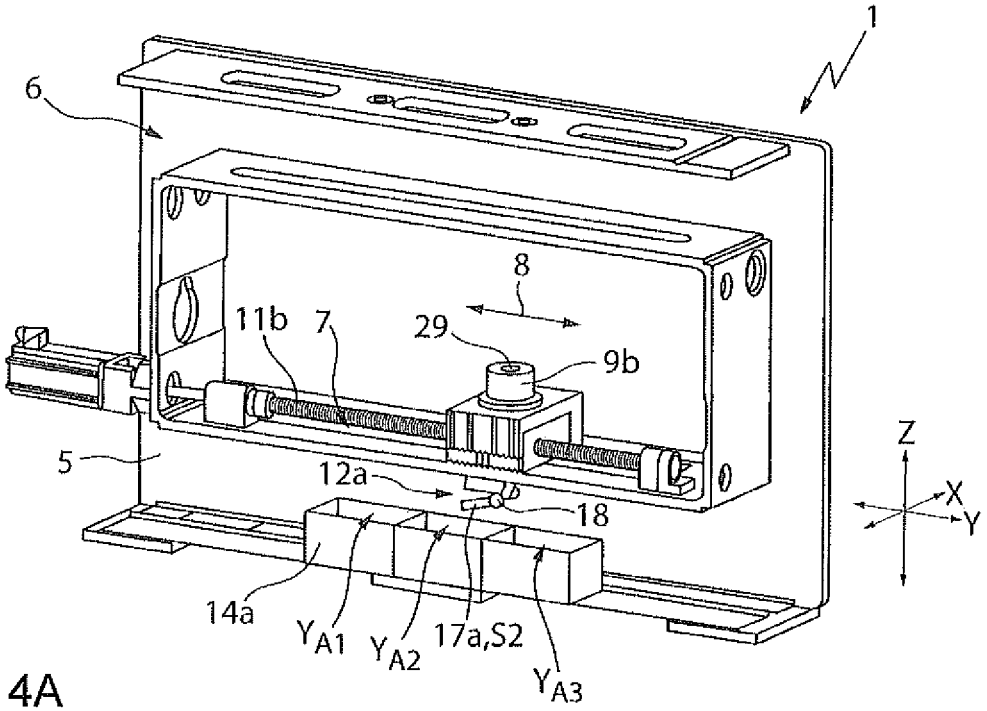
FIGS. 4A-4B show two views of details of the machine tool of FIG. 1 with a receiving device arranged below a stamping die.

FIG. 4A shows the machine tool 1 of FIG. 1 without the front part of the machine frame 5, in which the frame interior 6 with the gap 7 is easily visible. As may be identified in FIG. 4A, and in particular in FIG. 4B, the stamping die 9*b* has a continuous die opening 29, scrap parts and/or splinters and optionally good parts being able to pass through the opening under the action of gravitational force during the processing of the workpiece 2. Below the stamping die 9*b* a splinter pipe 30 is attached to a machine part (stamping support) of the spindle nut of the lower drive spindle 11*b* that may be moved together with the stamping die 9*b* in the gap 7, the splinter pipe adjoining the die opening 29 and forming a part of a (further) receiving device 12*a* for workpiece parts 2*a* to be ejected through the die opening 29 (scrap and optionally good parts).

Figure 4B:
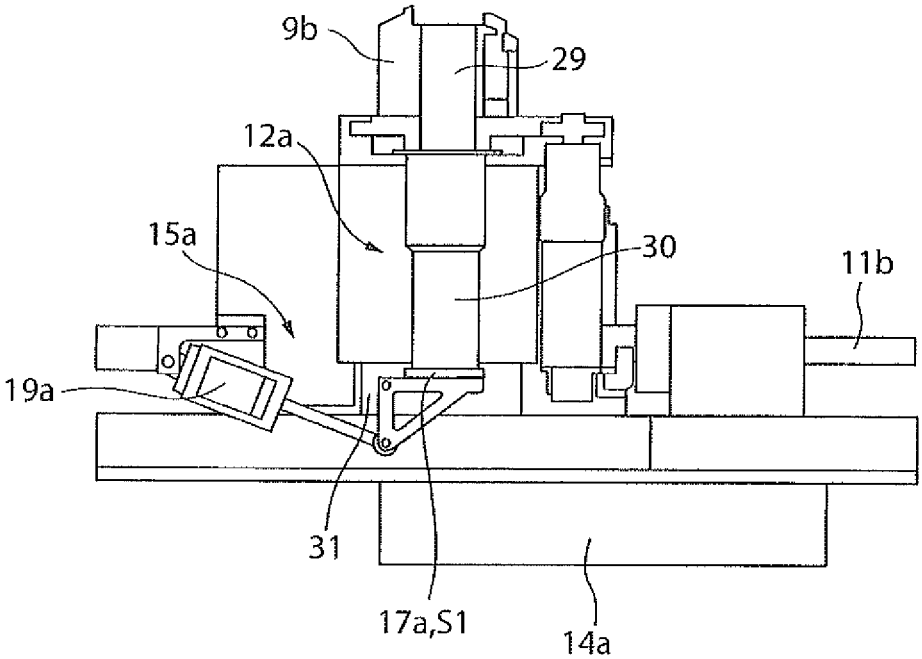

The (further) receiving device 12*a* has an ejection device 15*a* with a flap 17*a* that may be pivoted from a first horizontal pivoted position S1 shown in FIG. 4*b* in which the flap 17*a* closes the lower end of the splinter pipe 30 by means of an actuator 19*a*, which in the example shown is configured as a pneumatic cylinder, from the first pivoted position S1 into the second pivoted position S2 shown in FIG. 4A, in order to eject downwardly the workpiece parts 2*a*. As may be identified in FIG. 4A, a row of receiver containers 14*a* (boxes) is arranged below the flap 17*a* in the gap 7 to collect the workpiece parts 2*a*. The direction of the pivot axis 18*a* of the flap 17*a* is aligned parallel to the X-direction so that when opening the flap 17*a* the workpiece parts 2*a* are ejected to the side into the gap 7. To ensure that all of the workpiece parts 2*a* drop in the direction of the receiver containers 14*a*, a guide plate 31 is attached to the side of the machine part in the form of the stamping support at the height of the flap 17*a*.

As illustrated in FIG. 4A, by using the control device 13 described above, by the opening and/or pivoting of the flap 17*a* an ejection of workpiece parts 2*a* into collection containers 14*a* arranged at different ejection positions $Y_{A1}$, $Y_{A2}$, $Y_{A3}$ . . . inside the gap 7 may take place. For a standard emptying process, the stamping die 9*b* together with the receiving device 12*a* can be positioned at a tool changing position in the Y-direction, which for example is formed at the end of the movement path of the stamping die 9*b* along the lower drive spindle 11*b* shown in FIG. 4B. To permit an ejection that is as optimal as possible in terms of time, the emptying of the receiving device 12*a* and/or splinter pipe 30 takes place at the tool changing position or optionally—when the splinter pipe 30 is full—in the next collection container 14*a* in the Y-direction, if the sorting of the workpiece parts 2*a* into different collection containers 14*a* is dispensed with.

The collection containers 14*a* arranged in a row can be connected together via coupling elements so that they can be pulled together in the Y-direction out of the machine body 5. A different type of material and/or a different workpiece may be assigned to each of the collection containers 14*a*. For the sorting process, a suitable ejection position $Y_{A1}$, $Y_{A2}$, . . . $Y_{A3}$ is approached in the Y-direction and by opening the flap 17*a*, the respective workpiece parts 2*a* that bear against the flap 17*a* of the collection device 12*a* are ejected and collected there. If workpiece parts 2*a* in the form of good parts are also ejected through the die opening 29, one or more of the collection containers 14*a* may be used for collecting and/or optionally for sorting good parts.

The (further) receiving device 12*a*, in particular together with the receiving device 12 described in FIG. 1 to FIGS. 3A and 3B, may be used in the machine tool 1. In this case, a first row of collection containers 14 may be arranged adjacent to the gap 7 outside the machine frame 5 and a second row of collection containers 14*a* may be positioned inside the machine frame 5 in order to collect workpiece parts 2*a* received by the respective receiving device 12, 12*a*. However, optionally only the receiving device 12 described in FIG. 1 to FIGS. 3A and 3B or only the receiving device 12*a* described in FIGS. 4A and 4B, may be provided on the machine tool 1, in certain embodiments.

In the machine tool 1 described above, the movement of the pressing tool 9 and/or the stamping die 9*b* in the gap 7 may be advantageously used in order to eject workpiece parts 2*a* at different ejection positions $Y_{A1}$, . . . $Y_{A3}$ so that the sorting of different workpiece parts 2*a* may already be undertaken in the machine tool 1. Instead of a pressing tool 9 with a stamping punch 9*a* and a stamping die 9*b* other pressing tools 9 may also be used in the machine tool 1, for example pressing tools 9, which have a bending punch and a bending die. As an alternative to the common mobility of the stamping die 9*b* and the receiving device 12, 12*a* in the gap 7, described above, it is also possible to move the receiving device 12, 12*a* independently of the stamping die 9*b* in the gap 7. The receiving device 12, 12*a* may be moved from a position adjacent to the stamping die 9*b* or optionally a position arranged below the stamping die 9*b*, in which these workpiece parts 2*a* are received, controlled and moved independently from the stamping die 9*b* at different ejection positions $Y_{A1}, \ldots Y_{A3}$ along the gap 7. As soon as the workpiece parts 2*a* received in the receiving device 12, 12*a*, have been ejected at the ejection positions $Y_{A1}, \ldots Y_{A3}$, the receiving device 12, 12*a* may be moved into a position adjacent to the stamping die 9*b* in the gap 7 in order to receive workpiece parts 2*a* once again.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A machine tool for processing a workpiece, comprising:

a pressing tool;

a first movement device configured to move the workpiece in a first direction (X);

two workpiece supporting surfaces configured to support the workpiece, wherein the two workpiece supporting surfaces are spaced apart by a gap extending in a second direction (Y);

a second movement device configured to move the pressing tool in the second direction (Y), wherein the pressing tool comprises two tool components that are configured to move in a stroke direction (Z) relative to one another to process the workpiece in the gap by stamping, wherein the pressing tool further comprises a receiving device configured to move in the second direction (Y) in the gap for depositing at least one workpiece part cut off from the workpiece when processing the workpiece by the stamping, wherein the receiving device comprises a controllable ejection device for ejecting the at least one workpiece part deposited in the receiving device; and a control device configured to control the movement of the receiving device at different ejection positions ($Y_{A1}, \ldots Y_{A3}$) along the gap and configured to control the ejection device to cause ejection of the at least one workpiece part at the different ejection positions ($Y_{A1}, \ldots Y_{A3}$).

2. The machine tool of claim 1, wherein the receiving device is attached to one of the two tool components and is configured to be moved in the gap together with the tool component.

3. The machine tool of claim 1, wherein the receiving device comprises a parts container for depositing the at least one workpiece part.

4. The machine tool of claim 1, wherein the controllable ejection device comprises at least one pivotable flap configured to move into a first pivoted position (S1) for supporting the at least one workpiece part deposited in the receiving device and into a second pivoted position (S2) for ejecting workpiece parts from the receiving device.

5. The machine tool of claim 4, wherein a pivot axis of the at least one pivotable flap is aligned parallel with or perpendicular to the second direction (Y).

6. The machine tool of claim 4, wherein the at least one pivotable flap is configured to move into a third pivoted position (S3) for ejecting the at least one workpiece part from the receiving device, wherein an ejection direction (A1) in the second pivoted position (S2) differs from an ejection direction (A2) in the third pivoted position (S3).

7. The machine tool of claim 4, wherein the at least one pivotable flap forms a bottom region of a parts container.

8. The machine tool of claim 7, further comprising a further pivotable flap formed on a side region of the parts container and configured to have a first pivoted position (S1), wherein the further pivotable flap is adjacent to the bottom region of the parts container formed by the at least one pivotable flap, wherein the further pivotable flap is configured to have a second pivoted position (S2), wherein the further pivotable flap is spaced apart from the bottom region of the parts container.

9. The machine tool of claim 8, wherein the at least one pivotable flap and the further pivotable flap are coupled together in terms of movement.

10. The machine tool of claim 1, wherein the ejection device comprises at least one ejection chute for ejecting the at least one workpiece part from the receiving device in an ejection direction (A1, A2).

11. The machine tool of claim 10, wherein the ejection direction (A1, A2) extends transversely to the second direction (Y).

12. The machine tool of claim 1, wherein the receiving device comprises a feeding chute for feeding the at least one workpiece part from one of the tool components of the pressing tool.

13. The machine tool of claim 12, further comprising a sensor device for detecting the at least one workpiece part that pass the feeding chute or that protrude upwardly out of a parts container.

14. The machine tool of claim 1, wherein the receiving device is arranged below a continuous opening in a lower of the two tool components of the pressing tool.

15. The machine tool of claim 14, further comprising at least one guide element for guiding the at least one workpiece part when ejected from the receiving device into one or more collection containers arranged inside the gap.

16. A machine tool for processing a workpiece, comprising:

a pressing tool;

a first movement device configured to move the workpiece in a first direction (X);

two workpiece supporting surfaces configured to support the workpiece, wherein the two workpiece supporting surfaces are spaced apart by a gap extending in a second direction (Y);

a second movement device configured to move a the pressing tool in the second direction (Y), wherein the pressing tool comprises two tool components that are configured to move in a stroke direction (Z) relative to one another to process the workpiece in the gap by stamping, wherein the pressing tool further comprises a receiving device configured to move in the second direction (Y) in the gap for depositing at least one workpiece part cut off from the workpiece when processing the workpiece by the stamping, wherein the receiving device comprises a controllable ejection device for ejecting the at least one workpiece part deposited in the receiving device wherein the controllable ejection device comprises at least one pivotable flap configured to move into a first pivoted position (S1) for supporting the at least one workpiece part deposited in the receiving device and into a second pivoted position (S2) for ejecting workpiece parts from the receiving device, and wherein the at least one pivotable flap is configured to move into a third pivoted position (S3) for ejecting the at least one workpiece part from the receiving device, wherein an ejection direction (A1) in the second pivoted position (S2) differs from an ejection direction (A2) in the third pivoted position (S3).

* * * * *